US007500579B2

(12) United States Patent
Crossley

(10) Patent No.: US 7,500,579 B2
(45) Date of Patent: Mar. 10, 2009

(54) CUP WITH A PILL SHELF

(76) Inventor: David W. Crossley, 204 Klondike Rd., Charlestown, RI (US) 02813-2601

( * ) Notice: Subject to any disclaimer, the term of this patent is extended or adjusted under 35 U.S.C. 154(b) by 436 days.

(21) Appl. No.: 11/235,426

(22) Filed: Sep. 26, 2005

(65) Prior Publication Data

US 2007/0068949 A1 Mar. 29, 2007

(51) Int. Cl.
*A47G 19/22* (2006.01)
*B65D 21/02* (2006.01)

(52) U.S. Cl. ..... 220/703; 220/23.4; 220/503; 220/DIG. 13; 215/387; 206/528; 206/217; 604/78

(58) Field of Classification Search ..... 206/217, 206/229, 528, 530, 535, 538–540, 218; 215/386, 215/389–391, DIG. 3, DIG. 7, 387; 220/23.2, 220/23.4, 23.83, 23.86, 503, 697, 702, 735, 220/703; 222/192, 246, 288; 604/78; 99/317–322
See application file for complete search history.

(56) References Cited

U.S. PATENT DOCUMENTS

| | | | | | |
|---|---|---|---|---|---|
| 442,698 | A | * | 12/1890 | Yates | 604/57 |
| 1,264,539 | A | * | 4/1918 | Magel | 604/78 |
| 1,275,467 | A | * | 8/1918 | Poulalion | 604/78 |
| 1,748,297 | A | * | 2/1930 | Matson | 99/317 |
| 2,215,161 | A | | 9/1940 | Sapery | |
| 2,656,837 | A | * | 10/1953 | Bryan | 604/78 |
| 2,766,796 | A | | 10/1956 | Tupper | |
| 2,919,694 | A | * | 1/1960 | Von Gunten | 604/78 |
| 2,940,447 | A | * | 9/1960 | Zanegood | 604/78 |
| 3,331,369 | A | * | 7/1967 | Keck | 604/78 |
| 3,514,008 | A | | 5/1970 | Dorn | |
| 3,637,109 | A | | 1/1972 | Stifter | |
| 3,657,994 | A | * | 4/1972 | Post | 99/323 |
| 3,762,539 | A | | 10/1973 | Kerr | |
| 3,775,779 | A | * | 12/1973 | Kohler | 4/628 |
| 3,810,470 | A | * | 5/1974 | Von Gunten | 604/78 |
| 3,917,129 | A | | 11/1975 | Cavazza | |
| 3,931,891 | A | * | 1/1976 | Peppler | 206/538 |
| 4,024,590 | A | * | 5/1977 | Wendt | 4/628 |
| 4,051,977 | A | | 10/1977 | Steinfeld | |
| 4,135,512 | A | * | 1/1979 | Godsey | 604/78 |
| 4,324,338 | A | | 4/1982 | Beall | |
| 4,387,804 | A | | 6/1983 | Austin | |
| 4,416,370 | A | | 11/1983 | Beall | |
| 4,723,690 | A | | 2/1988 | vom Hofe | |
| 5,542,922 | A | | 8/1996 | Petterson et al. | |
| 5,699,937 | A | * | 12/1997 | Canela | 222/129 |
| 5,718,347 | A | * | 2/1998 | Walker et al. | 215/209 |
| 5,746,113 | A | * | 5/1998 | Ko | 99/323 |

(Continued)

FOREIGN PATENT DOCUMENTS

| | | | |
|---|---|---|---|
| EP | 0533300 | A1 | 3/1993 |

*Primary Examiner*—Anthony D Stashick
*Assistant Examiner*—Ned A Walker
(74) *Attorney, Agent, or Firm*—Wolf, Greenfield & Sacks, P.C.

(57) ABSTRACT

A drinking cup having an interior pill shelf with passages to allow liquid in the cup when drunk, to flow through the shelf and carry the pill with it into the mouth. A separate pill box is attached to the outside of the cup wall for carrying pills to be taken at a later time.

14 Claims, 2 Drawing Sheets

U.S. PATENT DOCUMENTS

D399,050 S * 10/1998 Evans ..... D3/203.2
5,853,106 A * 12/1998 Galluzzo ..... 220/731
5,913,966 A * 6/1999 Arnone et al. ..... 99/413
6,022,570 A * 2/2000 Richmond ..... 426/120
6,126,010 A * 10/2000 Kogen ..... 206/570
6,126,679 A 10/2000 Botts
6,129,241 A 10/2000 Rai
6,382,410 B1 * 5/2002 Magid et al. ..... 206/38.1
6,419,081 B1 7/2002 Ross
6,488,146 B1 * 12/2002 Dotsikas ..... 206/217
6,488,169 B1 12/2002 Magnusson et al.
6,502,713 B1 * 1/2003 Baker ..... 220/523
6,503,222 B2 * 1/2003 Lo ..... 604/77
6,666,329 B1 * 12/2003 Charbonneau ..... 206/218
6,679,375 B1 1/2004 Coory
6,971,759 B2 * 12/2005 Sutton ..... 362/101
2004/0056037 A1 * 3/2004 Gluck ..... 220/625
2004/0154954 A1 * 8/2004 Joan ..... 206/528
2006/0011639 A1 * 1/2006 Heilos ..... 220/717
2006/0016819 A1 * 1/2006 Paslawski et al. ..... 220/666
2006/0021989 A1 * 2/2006 Friedman ..... 220/703
2006/0021990 A1 * 2/2006 Friedman ..... 220/703

* cited by examiner

CUP WITH A PILL SHELF

BACKGROUND OF INVENTION

Field of Invention

This invention relates to a drinking cup provided with a support upon which one or more pills may be placed and which allows the liquid in the cup to wash through the support and sweep the pill or pills into the mouth and down the esophagus as the liquid is drunk from the cup. The cup may include a pill box removably mounted in the cup side wall, and the box may be opened and closed either while attached to or removed from the side wall.

SUMMARY OF INVENTION

The pill cup of the present invention includes as one aspect of the invention, a shelf assembly disposed in the cup above the normal fill line thereof, and the shelf has a flow path that allows liquid to flow through the shelf and pick up one or more pills disposed on it and causing the pill(s) to flow into the mouth of the person while drinking the liquid in the cup. The shelf assembly in the preferred embodiment has an inverted funnel-like extension beneath the pill support that communicates with the support to direct the liquid toward the pill and wash it into the mouth with the liquid.

In accordance with another aspect of the invention, the shelf assembly is formed as a separate part that snaps into place on the inner surface of the cup side wall.

As another aspect of the present invention, a pill box is provided attached to the cup and isolated from any liquid contained in the cup so that pills may be stored in the box.

In accordance with yet another aspect of this invention, a pill box attached to the cup is especially shaped so that it provides a support that may be engaged when the cup is held in the hand to enhance the grip on the cup by a person using it. As another aspect of the invention, the pill box can be opened and closed both when mounted on the cup and when removed from it.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
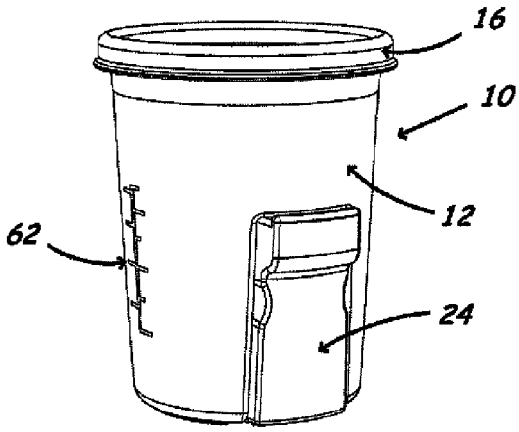
FIG. 1 is a perspective view of the pill cup and cover embodying the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The embodiment of the pill cup 10 of the present invention illustrated in the drawings has a side wall 12, bottom wall 14 and removable lid 16, all of which may be made of plastic, glass, or other similar material and in the preferred form, it is constructed as a reusable cup, but the invention may be embodied in a disposable cup as well. In the embodiment shown, the side wall 12 is generally frusto-conical in shape, but it should be appreciated that the cup may be of other shapes as well, such as with the side wall composed of a plurality of flat segments defining a polygon in cross-section. The cup 12 and lid 16 may typically be made of plastic as described more fully below. The lid 16 is designed to cooperate with the rim 18 of the cup to form an effective seal.

Figure 2:
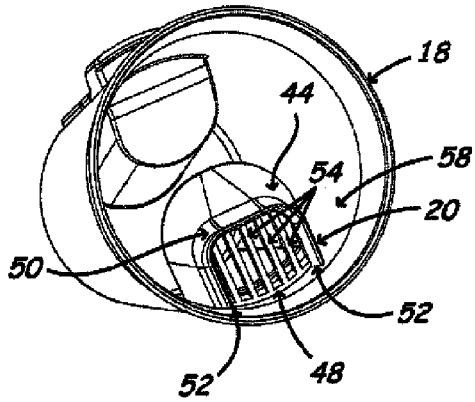
FIG. 2 is a top perspective view of the cup with the cover removed showing the pill shelf on the interior side wall of the cup.
Figure 4:
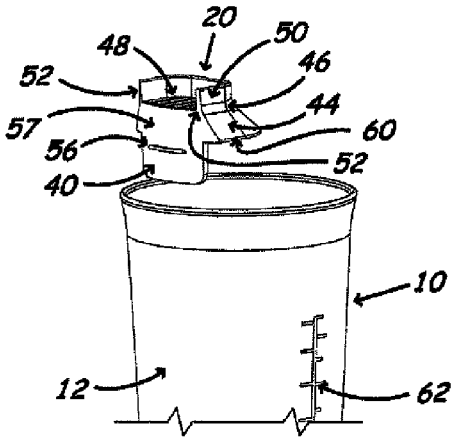
FIG. 4 is a fragmentary perspective view of the cup with the pill shelf assembly detached.
Figure 5:
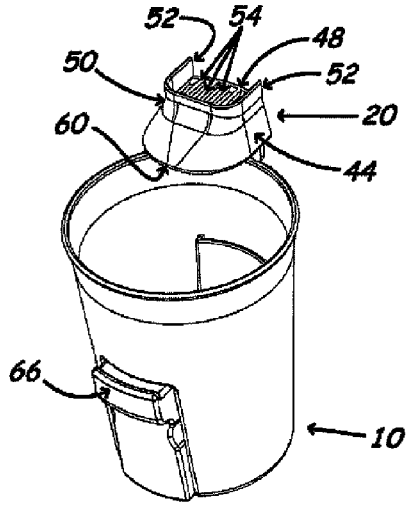
FIG. 5 is a perspective view of the cup with the pill shelf assembly detached.
Figure 7:
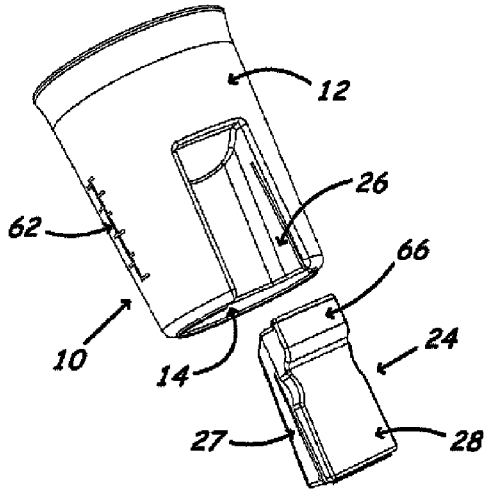
FIG. 7 is a perspective view of the cup with the pill box fully detached.

The embodiment of the invention shown includes a shelf structure 20 in the cup that defines a pill support 22 (see FIGS. 2, 4 and 5). The cup 10 carries a pill box 24 that preferably is detachable from the cup 12 so as to accommodate washing. The pill box 24 is detachably mounted in a slot 26 formed in the cup side wall 12 as shown in FIG. 7. The slot 26 does not interrupt the integrity of the side wall as the slot is formed as a cavity in the side wall outer surface. The pill box 24 has a hinged door 28 attached to the body portion 30 of the pill box, and the door 28 has a snap-fit with the body portion 30 so that it will snap closed and retain pills in the box interior 32. The snap fit is achieved by the lip 34 on the edge of the top wall 36 of the box and the top inside edge of the door 28. The door 28 is connected to the bottom 37 of box 24 by hinge 38.

Figure 3:
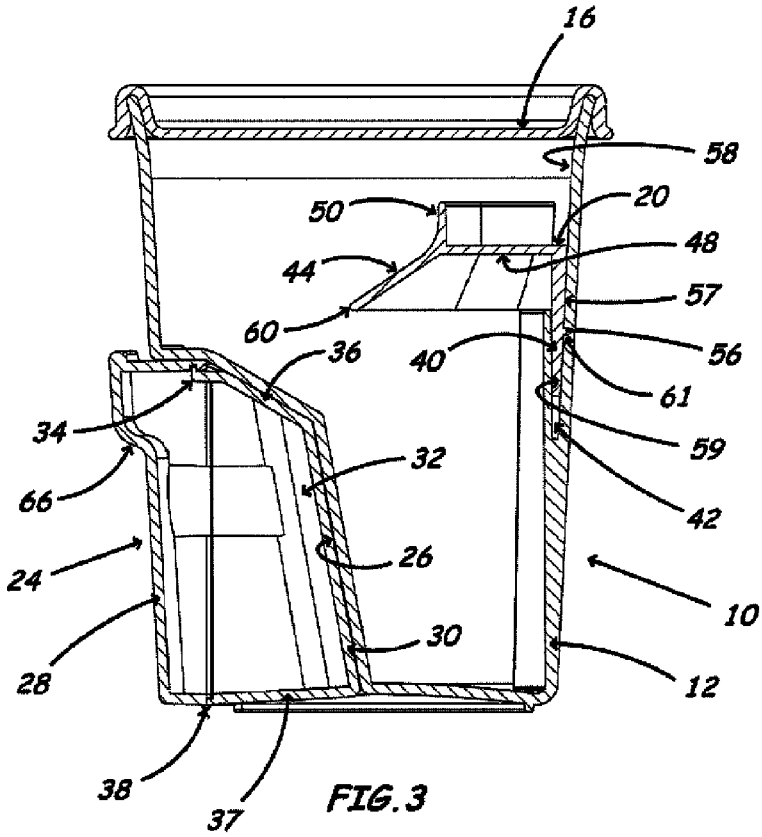
FIG. 3 is a vertical cross-sectional view of the pill cup taken along section line 3-3 of FIG. 2, and showing a pill box mounted in the cup side wall.
Figure 2A:
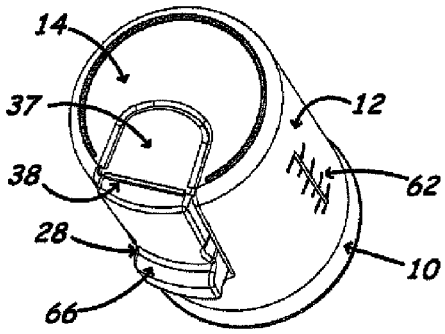
FIG. 2A is a bottom perspective view of the cup with the lid removed.
Figure 3A:
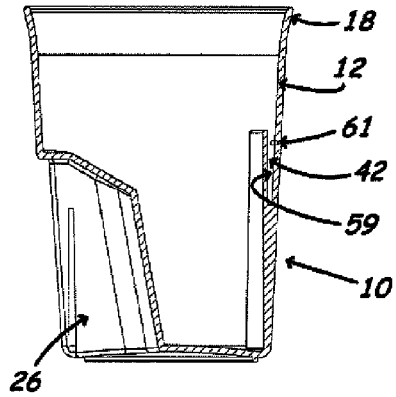
FIG. 3A is a cross-sectional view similar to FIG. 3 but with the pill shelf assembly and pill box removed.
Figure 6:
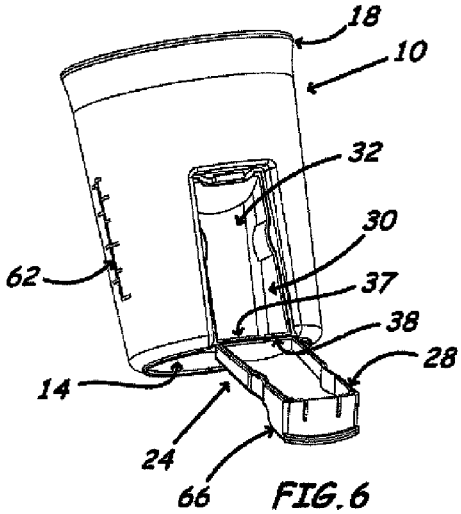
FIG. 6 is a perspective view of the cup with the pill box in place in the cup wall and with the pill box cover open.

The pill box 24 may be used to store pills to be taken at a later time. The pill box may be loaded either while the box is disposed in the slot 26 or removed from it (see FIGS. 6 and 7). The door 28 may be opened and closed in either position. The pill box may be made of the same material as the cup or any other material suitable for containing medication. The recess 26 conforms to the shape of the box and is disposed in the cup wall 12 opposite the shelf structure 20 and beneath that structure, as shown in FIG. 3. Preferably the pill box does not project an appreciable distance out of the normal contour of the side wall 12 so as not to interfere with grasping the cup with one hand. For added comfort, the pill box 24 may be contoured so as to enhance the grip and support of the cup. In the embodiment shown, the upper portion 66 of the door 28 extends out of the surface of the cup so as to enhance the grip on the cup. It will be appreciated that the pill box 24 may take a variety of different shapes, but should provide a storage space for pills totally isolated from any liquid in the cup.

Preferably the side walls 27 of the pill box 24 and the walls 29 of slot 26 have complimentary ribs and grooves to hold the box in place when attached to the cup but which allow the box to be separated from the cup when desired. Certain of ribs and slots may be oriented essentially vertically and others essentially horizontally to releasably retain the cup when pulled out the side or pulled out the bottom of the recess 26.

In accordance with another aspect of this invention, the shelf structure 20 is formed separately from the cup. The structure includes a tongue 40 designed as a complimentary fit to slot 42 in the side wall 12 of the cup. The tongue carries an inverted funnel-like member 44, and the narrow end 46 of the funnel joins a ledge 48 upon which a pill or pills to be consumed are placed (see FIGS. 2, 4 and 5). The ledge 48 is enclosed on three sides by an upwardly extending U-shaped wall 50 whose ends 52 are positioned closely adjacent the interior surface 58 of the cup side wall, as shown in FIG. 2. The ledge 48 is composed of a series of spaced apart ribs 54 that extend from the interior surface 58 of cup side wall to the U-shaped wall 50. It should be noted that the ends of the ribs adjacent the interior surface 58 of the cup side wall 12 together define an arc that conforms to the contour of the interior surface of the cup side wall 12. The shelf structure 20 and more particularly the ledge 48 supports a pill and the spaces between the ribs 54 allow water to pass through the ledge and wash the pills into the mouth of a person drinking from the cup. The funnel 44 directs the liquid to the bottom of the ledge 48 of the shelf structure 20 and more particularly to the spaces between the ribs 54.

The tongue 40 of the shelf structure 20 that fits into the slot 42 in the cup side wall 12 carries a rib 56 on its outer surface 57 that snaps into a corresponding groove 61 on the side 59 of the slot 42. The snap fit of the tongue 40 in the slot holds the shelf structure securely in place so that it will not accidentally be released. The rib and groove may be reversed and/or be formed on the inner wall of the slot 42, and other means may be employed to mount the shelf structure as well. The shelf structure is not intended to be released once it is attached to the cup. It is contemplated, however, that the shape of the shelf structure may take different shapes for different customers. For example, ledge 48 may conform to the shape of a particular pill of a manufacturer in the event the cup is used as a promotional item. The lid 16 may also carry the logo of the drug manufacturer.

In use, the cup may be filled preferably to a level below the bottom edge 60 of the funnel member 44. For convenience, a scale 62 (see FIG. 5) may be molded or printed into the cup side wall to assist in filling the cup in the event a particular volume of liquid such as water to be consumed with a pill is prescribed. The pill(s) to be taken is then placed on ledge 48 and thereafter the liquid is drunk from the cup, normally with the lips placed on the cup rim on the side of the cup carrying the shelf structure 20. The liquid in the cup will flow into the funnel and will be directed between the ribs 54 and wash the pill sitting on the ledge into the mouth and down the esophagus along with the liquid. More than one pill may be placed on the ledge at the same time so that all may be taken at once if desired.

Preferably the cup may be made of polypropylene (PP), the pill box and shelf structure of high density polyethylene (HDPE) and the lid of low density polyethylene (LDPE), but many other plastic materials may be used as well. For example, the cup may be made of HDPE, the pill box of medium density polyethylene (MDPE), the shelf structure of MDPE, LDPE or PP, and the lid of HDPE, MDPE or PP.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A container comprising:

a cup having a side wall and a closed bottom for holding a quantity of liquid to be consumed while swallowing one or more pills, a shelf connected to the side wall on the interior of the cup for supporting one or more pills, wherein the shelf includes a plurality of openings enabling liquid in the cup to wash the one or more pills into the mouth when the cup is tilted, and a pill box attached to the side wall of the cup with the pill box interior isolated from the cup interior for storing one or more pills in a dry environment, and an inverted funnel disposed beneath and connected to the shelf for directing liquid in the cup to flow through the shelf and carry the pills to the mouth when the cup is tilted for drinking, said funnel diminishing in cross section to the size and shape of the shelf where it connects to the bottom of the shelf, and wherein said funnel is configured to extend outwardly from the cup sidewalls and into the interior of the cup.

2. The container as defined in claim 1, wherein a major portion of the pill box is disposed in the interior volume of the cup.

3. The container as defined in claim 1, wherein the plurality of openings are formed by a plurality of spaced ribs that define the shelf.

4. The container as defined in claim 1, wherein the pill box is disposed in the side wall opposite the shelf and below the shelf.

5. The container as defined in claim 1, wherein the pill box has an exterior surface that extends outwardly from the side wall of the cup for assisting the user in holding the cup.

6. A container for dispensing pills for oral consumption comprising;

a drinking cup having bottom and side walls and an open top;

a substantially horizontal pill shelf in the cup connected to the cup side wall adjacent the top thereof, said shelf having a substantially smaller cross sectional area than a horizontal cross sectional area of the cup in the plane of the shelf, said shelf including a plurality of spaced apart ribs defining flow passages therebetween for supporting one or more pills disposed on it and enabling liquid in the cup to flow through the shelf and carry the one or more pills with the liquid; and an inverted funnel disposed beneath and connected to the shelf for directing liquid in the cup to flow between the ribs and carry the pills to the mouth when the cup is tilted for drinking, said funnel diminishing in cross section to the size and shape of the shelf where it connects to the bottom of the shelf.

7. The container as defined in claim 6, wherein the pill shelf further comprises a tongue extending downwardly from the ribs; and the cup further comprises a slot on an inside surface of the cup side wall for receiving the tongue to mount the shelf inside the cup.

8. The container as defined in claim 7, wherein the shelf has a side wall extending upwardly from the ends of the ribs remote from the cup side wall for containing the one or more pills on the shelf until the pills are carried away by liquid flowing through the ribs.

9. The container as defined in claim 6, wherein a pill box is attached to the cup for storing one or more pills in a dry environment.

10. The container as defined in claim 9, wherein the pill box has an exterior surface that extends outwardly from the side wall of the cup for assisting the user in holding the cup.

11. The container as defined in claim 9, wherein the pill box comprises a main container and a hinged cover and wherein the pill box is detachable from the cup.

12. The container as defined in claim 11, wherein the hinged cover of the pill box can be opened and closed both when the pill box is attached and detached from the cup.

13. The container as defined in claim 12, wherein a cavity is provided in the cup side wall and accessible from the outside of the cup for receiving the pill box.

14. The container as defined in claim 13, wherein the pill box can be opened and closed both when the pill box is in or out of the cavity.

* * * * *